United States Patent [19]

Pollack

[11] Patent Number: 4,955,310

[45] Date of Patent: Sep. 11, 1990

[54] BEARING ARRANGEMENT FOR SINGLE POINT TERMINAL

[76] Inventor: Jack Pollack, 23901 Calabasas Rd., #2090, Calabasas, Calif. 91302

[21] Appl. No.: 282,020

[22] Filed: Dec. 8, 1988

[51] Int. Cl.[5] ..... B63B 21/50

[52] U.S. Cl. ..... 114/230; 441/5

[58] Field of Search ..... 441/3, 4, 5; 114/259, 114/230

[56] References Cited

U.S. PATENT DOCUMENTS

| | | | |
|---|---|---|---|
| 3,601,075 | 8/1971 | Deslierres | 441/5 |
| 4,311,412 | 1/1982 | Guilbeau | 114/219 |
| 4,459,930 | 7/1984 | Flory | 441/5 |
| 4,648,848 | 3/1987 | Busch | 441/3 |
| 4,650,431 | 3/1987 | Kentosh | 114/230 |

*Primary Examiner*—Sherman Basinger
*Assistant Examiner*—Stephen P. Avila
*Attorney, Agent, or Firm*—Freilich, Hornbaker Rosen

[57] ABSTRACT

A bearing arrangement is described for mounting a turret on the outer ends of beams whose inner ends are supported by a vessel that can weathervane about the turret. A lower bearing arrangement that mounts a lower portion of the turret in rotation about a vertical axis to a lower beam, permits the lower turret portion to pivot about a pair of lower horizontal axes. An upper bearing arrangement that mounts an upper portion of the turret to an upper beam in rotation about the vertical axis, permits the upper turret portion to pivot about a pair of upper horizontal axes.

14 Claims, 3 Drawing Sheets

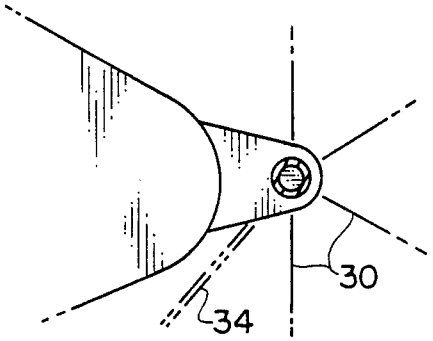
FIG. 2
FIG. 1
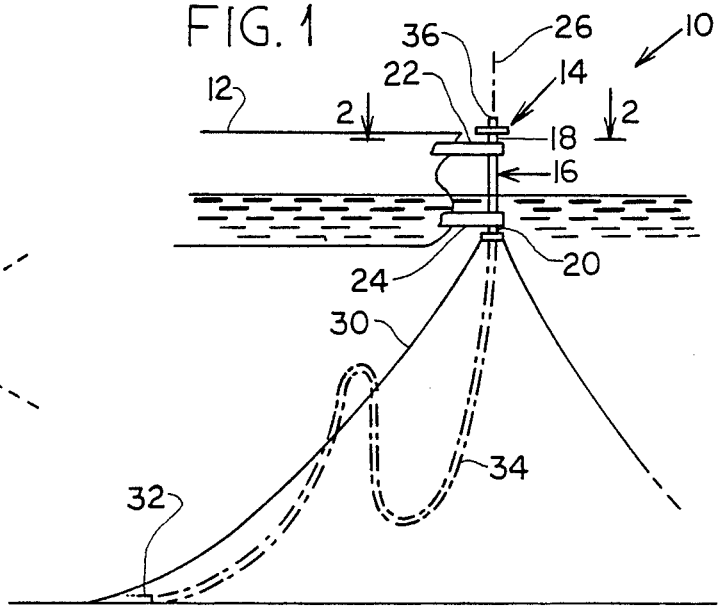
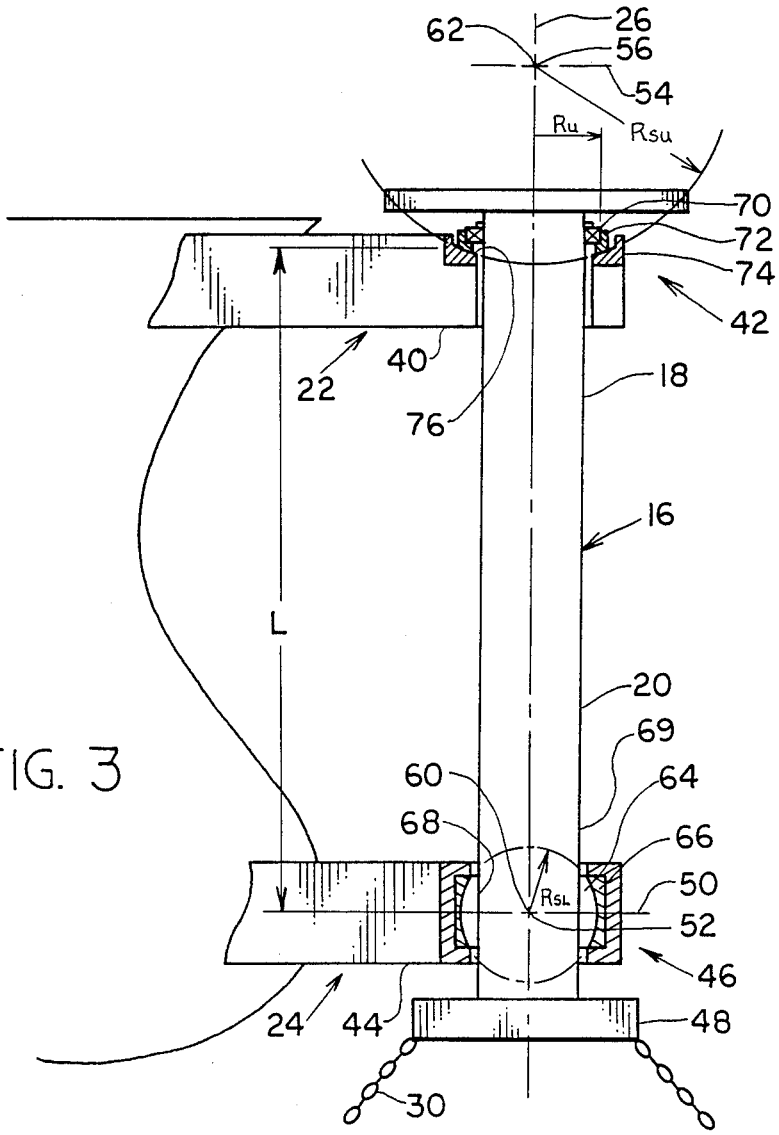
FIG. 3

BEARING ARRANGEMENT FOR SINGLE POINT TERMINAL

BACKGROUND OF THE INVENTION

One type of offshore terminal for mooring a ship includes upper and lower beams extending from the bow of the ship and supporting a turret in rotation about a vertical axis relative to the ship. The lower portion of the turret is anchored to the sea floor, as by heavy chains. An upper bearing arrangement that mounts the turret to the upper beam, includes a thrust bearing that supports the weight of the turret and the load thereon, and that also forms a radial bearing that resists horizontal movement of the turret. A lower bearing arrangement that mounts the turret to the lower beam includes only a radial bearing. The turret is rigid, and the upper and lower bearings must be precisely aligned to avoid large bending stresses on the turret which would result in large radial loads on the bearings that limit their useful life.

In practice, it is found difficult to mount the radial bearings on the upper and lower beams to be precisely aligned. For example, even if the bearings are precisely aligned when the turret is installed on the vessel, misalignment will occur at the site where the terminal is installed when heavy chains are attached to the turret. The heavy weight of the chains causes the upper beam to bend, and in bending its outer ends pivot, which results in misalignment of the bearings. A comprehensive analysis can be made to predict the degree of bending of the upper beam, but in practice such analysis is very difficult to perform accurately. Also, it is difficult to install the turret at a shipyard with the required amount of misalignment and consequent bending load on the turret, which is predicted to be compensated for when the chains are installed. A bearing arrangement which avoided the need to accurately predict the amount of bearing misalignment during final installation and the need to install the bearings under high load with high precision, would be of considerable value.

SUMMARY OF THE INVENTION

In accordance with one embodiment of the present invention, a bearing arrangement is provided for mounting the upper and lower portions of a rigid turret on a vessel, which avoids the need for precise alignment of upper and lower bearings. Upper and lower bearing arrangements each allow the corresponding turret portion to pivot about horizontal axes, to thereby avoid the need for precise alignment of the upper and lower bearing arrangements, and to avoid large radial loads on the bearings that could shorten their lives.

The novel features of the invention are set forth with particularity in the appended claims. The invention will be best understood from the following description when read in conjunction with the accompanying drawings.

BRIEF DESCRIPTION OF THE DRAWINGS

FIG. 1 is a side elevation view of an offshore terminal of the present invention.

FIG. 2 is a simplified view taken on the line 2—2 of FIG. 1.

FIG. 3 is a sectional view of a portion of the terminal of FIG. 1.

DESCRIPTION OF THE PREFERRED EMBODIMENTS

Figure 4:
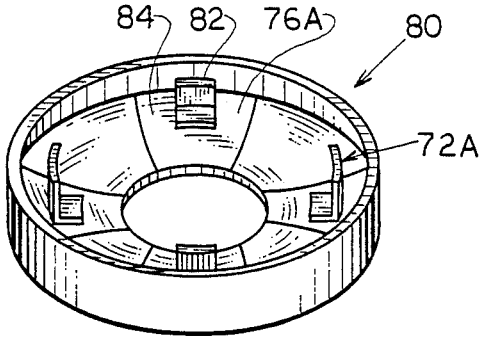
FIG. 4 is a partial perspective view of an upper bearing arrangement constructed in accordance with another embodiment of the present invention.

FIG. 1 illustrates a single point terminal 10 wherein a vessel 12 is moored by a transfer structure 14 in the form of a turret 16. The turret has upper and lower portions 18, 20 supported on the vessel by upper and lower mounts 22, 24 that allow the turret to rotate about a vertical axis 26 relative to the vessel. The lower portion of the turret is anchored to the sea floor as by several catenary chains 30. Such a terminal is generally used to transfer hydrocarbons between the vessel and an underground pipeline 32 that may extend from underwater oil wells. A conduit 34 is indicated which extends up from the sea floor to the turret, and to a fluid swivel 36 at the top of the turret to the vessel.

FIG. 3 shows the manner in which the turret 16 is supported on the vessel. The upper mount 22 includes an upper attachment structure or beam 40 and an upper bearing arrangement 42 that mounts the upper turret portion 18 to the beam. Similarly, the lower mount 24 includes a lower attachment structure or beam 44 and a lower bearing structure 46 that supports the lower turret portion 20 on the lower beam. The lower portion of the turret includes a chain table 48 to which the mooring chains 30 are attached. The chains 30 are of great weight, in that drifting of the vessel causes portions of the chain to be lifted off the sea floor, thereby storing potential energy that urges the vessel back towards a quiescent position. The upper bearing arrangement 42, which is the most accessible for maintenance, supports the weight of the turret as well as the heavy load of chains, etc. thereon, while also limiting horizontal, or radial, movement of the upper turret portion. The lower bearing arrangement 46 does not support any turret weight, but limits horizontal, or radial, movement of the lower turret portion.

The turret 16 is rigid against bending. In prior terminals of the general type illustrated, heavy-duty bearings were used to mount the turret on the beams, with each bearing having an inner race fixed to the turret and an outer race fixed to the beam. Great care was taken to assure that the upper and lower bearing arrangements were precisely aligned to minimize radial loading on the bearings due to misalignment. However, obtaining such precision alignment was very difficult. The bearings and turret can be mounted on the beams at a ship yard with precise alignment of the bearings. However, the mooring chains are attached to the chain table at the lower end of the turret only at the ocean site where the terminal is installed. When the very heavy chains are attached to the turret, the upper beam which holds the upper turret portion to the vessel, undergoes bending. Previously, a comprehensive analysis was required to predict the degree of bending of the upper beam and consequent pivoting and movement of the upper bearing when the chains were applied, and to initially mount the bearings in misalignment by an amount that resulted in alignment when the chains were installed. However, such an analysis is difficult and is not always sufficiently accurate. Also, it is difficult to mount bearings in precise alignment in a ship yard, and even more difficult to mount the bearings in a precise degree of misalignment since they must withstand heavy loads during bearing installation if they are to be misaligned.

In accordance with the present invention, the upper and lower bearing arrangements 42, 46 are constructed so they each allow a corresponding portion of the turret to pivot about horizontal axes. The lower bearing arrangement 46 permits pivoting of the lower turret portion 20 about a pair of perpendicular horizontal lower axes 50, 52. Similarly, the upper bearing arrangement 42 permits the upper turret portion 18 to pivot about a pair of perpendicular substantially horizontal upper axes 54, 56. Actually, each bearing arrangement permits a corresponding portion of the turret to pivot in any direction about a point or center of pivoting 60, 62 located substantially along the vertical axis of rotation 26 of the turret (assuming the vessel is horizontal), with the upper pivot point 62 lying above the lower pivot point 60. The fact that the upper and lower portions of the turret can each pivot about horizontal axes, results in elimination of the need for precise installation of the upper and lower bearing arrangement to assure their alignment. The need for precise alignment is avoided because the upper and lower bearing arrangements automatically come into alignment, and remain so even when the heavy chains 30 are attached to the turret which causes the upper beam 40 to bend.

The lower bearing arrangement 46 is formed by a spherical inner bearing 64 having a spherical outer surface, and a spherical outer bearing 66 having a spherical inner surface that mates with the surface of the inner bearing. The turret lower portion 20 can rotate freely within a cylindrical inner surface 68 formed on the inside of the spherical inner bearing 64. The spherical inner bearing 64 can be constructed of a bearing material such as aluminum bronze which has relatively low friction against suitable materials used for the spherical outer bearing 64 and for the outer surface 69 of the lower turret portion 20.

The upper bearing arrangement 42 uses a combination radial and thrust bearing 70 such as of a three race roller type, to provide low friction that allows the vessel to weathervane or rotate about the turret, despite the weight of heavy chains on the turret. The inside of the thrust bearing is mounted on the turret upper portion, while the outside of the thrust bearing is mounted on a support 72. The support 72 is slideably mounted on a bearing device 74 which has a substantially spherical support surface 76 centered about the point 62. The upper turret portion pivots about the point 62 as the support 72 slides on the spherical support surface 76. The surface 76 of the bearing device faces primarily upwardly to enable it to support the heavy load on it. The fact that the bearing surface 76 is spaced far from the center of pivoting 62 results in appreciable sideward movement of the support 72 as the upper bearing arrangement pivots, and clearances are provided about the upper turret portion to permit such horizontal sliding. The fact that the upper turret portion slides on a support surface 76 spaced below the center of pivoting 62, results in slight sideward and upward movement of the turret as it pivots on the support surface away from a quiescent, centered, position. The lower turret portion 20 can slide vertically within the cylindrical inner surface 68 of the spherical inner bearing 64, to allow slight sideward and upward movement of the upper turret portion.

It is desirable that the upper bearing arrangement urge the support 72 towards a position centered on the surface of the bearing device 74. If the support surface 76 were flat or curved about a center lying below the upper bearing arrangement, then the support 72 would quickly move or fall to one side of the vertical axis 26, and remain there until there was sufficient mooring force urging it away from that side. This would result in maximum "wobble" or precession of the axis 26 as the ship weathervaned about the turret. [Why is this undesirable?]. Accordingly, applicant prefers to curve the support surface 76 about a center 62 located above the support surface 76, by a distance $R_{su}$ that is not too great. For a given bearing radius $R_u$ applicant prefers that the radius of curvature $R_{su}$ of the support surface 76 be no more than about 5 times $R_u$. Applicant also prefers that $R_{su}$ be at least equal to the square root of two times $R_u$, or in other words at least about 1.5 times as great. A smaller $R_{su}$ would result in the support surface 76 being greatly angled from the horizontal, so there would be a considerably greater force on the surface 76 for a given weight of the turret and the load thereon and for a given misalignment. Applicant also prefers that the radius of curvature $R_{su}$ of the support surface 76 be less than the distance L between the upper and lower bearing arrangements; so only moderate radial loads are applied to the upper and lower bearing arrangements to withstand the torque created by mooring forces as one or more of the anchor chains 30 is pulled tighter.

The bearing device 74 can be formed of an aluminum bronze-type material, with grease occasionally applied to minimize friction. Moderate friction is acceptable because there is little movement of the support 72 on the bearing device 74. Much less friction can be tolerated at the thrust bearing 70 and in rotation of the lower turret portion 20 about the vertical axis 26 on the surface 68.

It should be noted that as the vessel weathervanes about the single point terminal, almost all rotation occurs at the thrust bearing 70 and at the light duty radial bearing formed by the lower turret portion 20 and the surface 68. Pivoting about the spherical bearings formed by the upper elements 72, 74 and lower elements 64, 66 is only slight. Accordingly, it is possible to form the spherical elements as segments that allow only a limited angle of pivoting in any direction about the corresponding centers of spherical curvature.

FIG. 4 illustrates another spherical thrust bearing assembly 80 wherein the support 72A is in the form of several individual segments such as 82. Each segment such as 82 lies on a spherical support surface 76A, with only segments such as 84 of the support surface being highly finished for low resistance to sliding.

Figure 5:
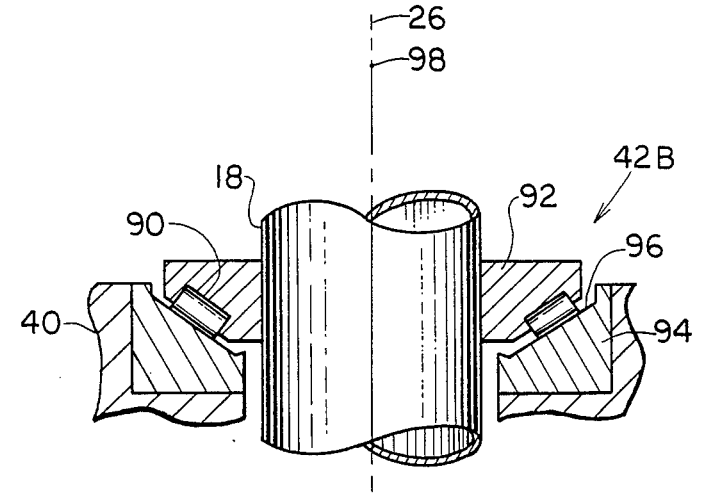
FIG. 5 is a partial sectional view of an upper bearing arrangement of another embodiment of the invention.

FIG. 5 illustrates another upper bearing arrangement 42B which includes roller bearing elements 90 captured by an inner raceway or support 92 that is fixed to the upper portion 18 of the turret. The bearing arrangement also includes an upper raceway or bearing device 94 with a support surface 96 curved about a point 98 lying along the vertical axis 26. The outer raceway 94 is mounted on the upper beam 40. The upper turret portion 18 can pivot about the location 98 by the fact that the roller bearing elements 90, which have the same outer curvature as surface 96, can roll around different paths on the support surface.

Figure 6:
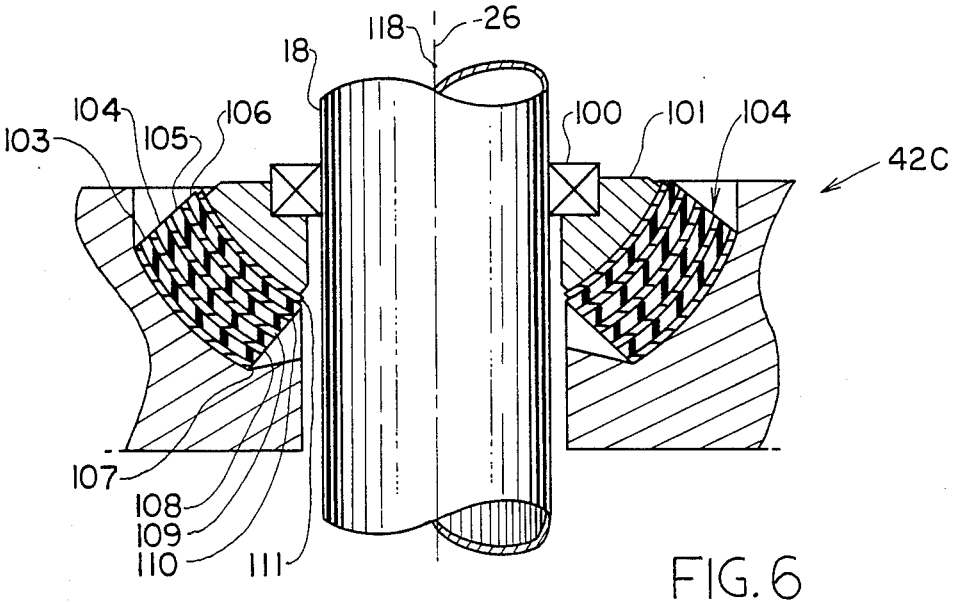
FIG. 6 is a partial sectional view of an upper bearing arrangement of another embodiment of the invention.

FIG. 6 illustrates another upper bearing arrangement 42C which uses elastomeric material to permit pivoting of the upper turret portion 18. The arrangement includes a conventional thrust and radial bearing combination 100 with an inner raceway mounted to the upper turret portion 18 and an outer raceway mounted to a support 101. The support 101 lies on an elastomeric support structure 102 that includes a quantity of elastomeric material arranged in several sheets 103–106. Each sheet is composed of segments that are spherically curved to lie equidistant from point 116. Metal plates 107–111 that separate the elastomeric sheets, are also composed of segments spherically curved about the point 116. The plates 107–111 enable control of deflection of the elastomeric sheets and avoid damage to them. The elastomeric support structure 102 can be in the form of several substructures spaced about the vertical axis 26 for ease of construction. Limited pivoting of the upper turret portion about the point 116, occurs by shearing deformation of elastomeric supports on one side in downward and inward directions, and shearing deformations of elastomeric supports on the other side in upward and outward directions. Some degree of precision is required in analyzing the orientation of the bearings after the chains are installed and in installing the bearings, but the precision is much less than would be required in the absence of the elastomeric support structure.

Figure 7:
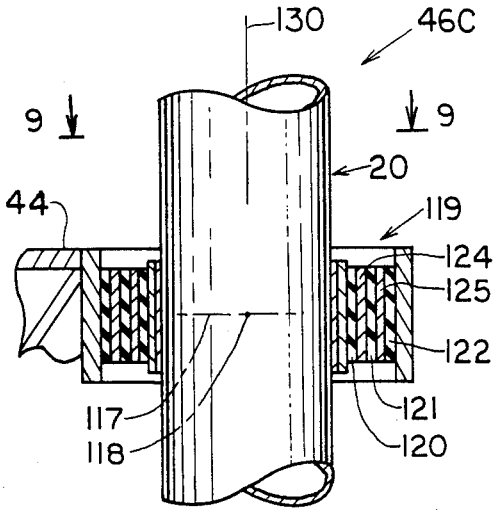
FIG. 7 is a sectional view of a lower bearing arrangement of another embodiment of the invention.
Figure 8:
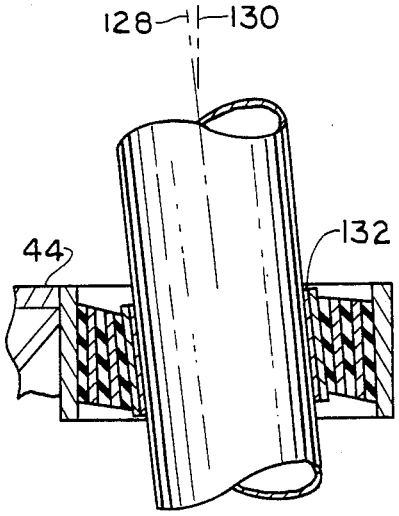
FIG. 8 is a view similar to that of FIG. 7, but with the turret tilted.
Figure 9:
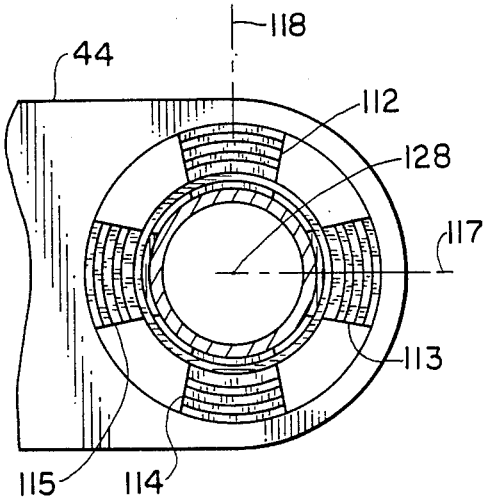
FIG. 9 is a view taken on the line 9—9 of FIG. 7.

FIGS. 7–9 illustrate another lower bearing arrangement 46C which uses elastomeric (e.g., rubber) material to permit pivoting of the lower turret portion 20 about horizontal axes 117, 118. The arrangement includes an elastomeric support structure 119 with substructures 112–115 (FIG. 9) that each includes elastomeric sheets 120–122 (FIG. 7) separated by metal plates 124–125. The sheets lie in substantially vertical "planes" (that is, imaginary lines normal to any sheet location extend substantially horizontally) because they are not subjected to substantial vertical loads. The sheets are subjected only to torques that result in uneven horizontal compressive loads on each sheet when the turret axis 128 tilts, as in FIG. 8, with respect to the usually vertical axis 130 of the lower beam 44. Aluminum bronze bearing pads 132 that bear on the turret, avoid substantial vertical loads on the elastomeric sheets as the turret shifts vertically.

While the illustrated single point terminal of FIG. 1 is of the type wherein the turret is mounted on the ends of beams extending from the bow of a vessel, it should be understood that the present bearing arrangement is useful in a variety of mounting arrangements, such as where the turret lies in a moon pool at the middle of a vessel and where the beam or beams may extend completely about the turret.

In the above described arrangements, the upper bearing arrangement such as 42 in FIG. 3 is constructed specifically so it can pivot about horizontal axes 54, 56 to avoid the need for precise alignment of the upper and lower bearing arrangements. It is known in the art of constructing and mounting of rolling contact bearings such as ball bearings, that the sizes of the balls and inner and outer races must be held to very close tolerances. Such tolerances are generally much less than 1 thousandth of an inch. Otherwise, there will not be an even load distribution.

It is also known that the inner and outer races of an ordinary ball bearing must fit tightly on the shaft and housing. Such fit is necessary to avoid slipping and creeping that may cause rapid wear of both the shaft and bearing rings. To prevent such wear, the bearing is generally mounted with a press fit to the shaft and a push fit to the housing. Even a relatively low tolerance fit requires that the tolerance of the housing be held to less than 3 thousandths inch for a nine inch diameter bearing. Also, the outer bearing is generally clamped in position. The close tolerances, which allow pivoting substantially only by bending of the shaft and mounts, do not allow for "substantial" pivoting of the shaft on the housing. Applicant's upper bearing arrangement allows for a "substantial amount" of pivoting of the shaft or turret, which is herein defined as pivoting by more than twice what is allowed only by bending of the turret (16) or of the material of the upper and lower mounts (40,44).

Thus, the invention provides a bearing arrangement for mounting the upper and lower portion of a turret to a vessel to enable weathervaning of the vessel about the turret, which avoids the need for high precision in the mounting of the bearing arrangements, and the need for correcting for deflections that occur after heavy loads are applied to the turret. The system includes upper and lower bearing arrangements that each permit pivoting of a corresponding turret portion about horizontal axes to permit alignment of the two bearing arrangements so as to avoid high bending loads on the rigid turret. Where the upper bearing arrangement carries the entire weight of the turret and of the load thereon, such as of anchor chains, the upper bearing arrangement can include a combination thrust and radial bearing mounted to the turret and held on a support which can slide on the spherical surface of a bearing device. In another embodiment of the invention, a mass of elastomeric material, such as in the form of multiple rubber plates surrounded by steel plates, supports a combination thrust and radial bearing which holds the upper turret portion. In still another embodiment, roller bearings which form combination thrust and radial bearings, include a wide raceway along which the roller elements can roll along different circular paths. The lower bearing arrangement preferably allows vertical sliding of the lower turret portion relative to the rest of the bearing arrangement, and may include spherical bearing elements.

Although particular embodiments of the invention have been described and illustrated herein, it is recognized that modifications and variations may readily occur to those skilled in the art and consequently it is intended to cover such modifications and equivalents.

What is claimed is:

1. In a mooring arrangement which includes a vessel that floats at the surface of a sea and that can drift and weathervane, a turret, and vertically spaced upper and lower mounts mounting vertically spaced upper and lower portions of the turret to the vessel to enable relative rotation of the vessel and turret about a largely vertical axis, and wherein the turret has a lower end anchored by at least one mooring line or the like extending down toward the sea floor and applying a largely downward force to the lower end of the turret, the improvement wherein:

said lower mount includes a lower bearing arrangement that limits radial movement of said turret with respect to said axis while allowing pivoting of said lower turret portion about lower horizontal axes;

said upper mount includes an upper bearing arrangement that limits both radial and downward movement of said turret with respect to said axis while allowing a substantial amount of pivoting of said upper turret portion about upper horizontal axes.

2. The mooring arrangement described in claim 1 wherein:

said turret is slideable in a substantially vertical direction with respect to said lower bearing arrangement.

3. The mooring arrangement described in claim 1 wherein:

said upper bearing arrangement includes a combination radial and thrust bearing coupled to said upper turret portion, a support coupled to said combination bearing to support it, and means for holding said support in pivoting about said upper horizontal axis, and wherein said upper horizontal axes lie at a location which is substantially along said vertical axis and above said combination bearing.

4. In a mooring arrangement which includes a vessel, upper and lower mounts that each include a beam with an inner portion mounted on the vessel and an outer portion and a bear arrangement on each other beam portion, and a turret with vertically spaced upper and lower portions rotatably mounted on said bearing arrangements about a largely vertical axis, wherein the turret is anchored to a sea floor by an anchor arrangement that applies a largely downward load to the turret, the improvement wherein:

said bearing arrangement allows said turret upper and lower portions to each pivot a substantial amount about a different horizontal axis lying substantially along said largely vertical axis, and to allow one of said turret portions to slide vertically by a limited amount relative to the corresponding beam.

5. In a mooring arrangement which includes a vessel that floats at the surface of a sea and that can drift and weathervane, a turret, and upper and lower mounts mounting upper and lower portions of the turret to the vessel to enable relative rotation of the vessel and turret about a largely vertical axis, and wherein the turret has a lower end anchored by at least one mooring line or the like extending down toward the sea floor and applying a largely downward force to the lower end of the turret, the improvement wherein:

said lower mount includes a lower bearing arrangement that limits radial movement of said turret with respect to said axis while allowing pivoting of said lower turret portion about lower horizontal axes;

said upper mount includes an upper bearing arrangement that limits both radial and downward movement of said turret with respect to said axis while allowing pivoting of said upper turret portion about upper horizontal axes;

said upper bearing arrangement includes a combination radial and thrust bearing coupled to said upper turret portion, a support coupled to said combination bearing to support it, and a bearing device forming a substantially spherical bearing surface curved substantially about a location lying along said vertical axis and above said combination bearing, said support being slideaably supported on said bearing surface.

6. In a mooring arrangement which includes a vessel that floats at the surface of a sea and that can drift and weathervane, a turret, and upper and lower mounts mounting upper and lower portions of the turret to the vessel to enable relative rotation of the vessel and turret about a largely vertical axis, and wherein the turret has a lower end anchored by at least one mooring line or the like extending down toward the sea floor and applying a largely downward force to the lower end of the turret, the improvement wherein:

said lower mount includes a lower bearing arrangement that limits radial movement of said turret with respect to said axis while allowing pivoting of said lower turret portion about lower horizontal axes;

said upper mount includes an upper bearing arrangement that limits both radial and downward movement of said turret with respect to said axis while allowing pivoting of said upper turret portion about upper horizontal axes;

said upper bearing arrangement includes a combination radial and thrust bearing coupled to said upper turret portion, and a quantity of elastomeric material that supports said combination bearing and that permits pivoting and horizontal shifting of said combination bearing by elastic deformation of said elastomeric material.

7. In a mooring arrangement which includes a vessel that floats at the surface of a sea and that can drift and weathervane, a turret, and upper and lower mounts mounting upper and lower portions of the turret to the vessel to enable relative rotation of the vessel and turret about a largely vertical axis, and wherein the turret has a lower end anchored by at least one mooring line or the like extending down toward the sea floor and applying a largely downward force to the lower end of the turret, the improvement wherein:

said lower mount includes a lower bearing arrangement that limits radial movement of said turret with respect to said axis while allowing pivoting of said lower turret portion about lower horizontal axes;

said upper mount includes an upper bearing arrangement that limits both radial and downward movement of said turret with respect to said axis while allowing pivoting of said upper turret portion about upper horizontal axes;

said lower bearing arrangement includes a quantity of elastomeric material coupled to said lower turret portion and that resists pivoting of said lower turret portion by elastic deformation of said elastomeric material.

8. The mooring arrangement described in claim 7 wherein:

said elastomeric material is in the form of a plurality of sheet oriented so lines normal to the sheets extend horizontally, and a plurality of rigid plates each lying between a pair of said sheets.

9. In a mooring arrangement which includes a vessel, upper and lower mounts that each include a beam with an inner portion mounted on the vessel and an outer portion and a bearing arrangement on each outer beam portion, and a turret with upper and lower portions rotatably mounted on said bearing arrangements about a largely vertical axis, wherein the turret is anchored to a sea floor by an anchor arrangement that applies a largely downward load to the turret, the improvement wherein:

said bearing arrangement allows said turret upper and lower portions to each pivot about a different horizontal axis lying substantially along said largely vertical axis, and to allow one of said turret portions to slide vertically by a limited amount relative to the corresponding beam;

said bearing arrangements include upper and lower bearing arrangements respectively mounted on said upper and lower beams;

said lower bearing arrangement includes a first device mounted on said lower beam and having a spherical inner surface, and a second element with a spherical outer surface matching and concentric with said inner surface and lying therein to pivot about the center of said spherical inner surface, said second element having a substantially cylindrical hole lying along said axis and said turret lower portion is slideable along said axis within said hole.

10. In a mooring arrangement which includes a vessel, upper and lower mounts that each include a beam with an inner portion mounted on the vessel and an outer portion and a bearing arrangement on each outer beam portion, and a turret with upper and lower portions rotatably mounted on said bearing arrangements about a largely vertical axis, wherein the turret is anchored to a sea floor by an anchor arrangement that applies a largely downward loan to the turret, the improvement wherein:

said bearing arrangement allows said turret upper and lower portions to each pivot about a different horizontal axis lying substantially along said largely vertical axis, and to allow one of said turret portions to slide vertically by a limited amount relative to the corresponding beam;

said bearing arrangement includes upper and lower bearing arrangements respectively mounted on said upper and lower beams;

said upper bearing arrangement includes a bearing device mounted on said outer portion of said upper beam and forming a bearing surface curved substantially spherically about a center lying along said axis and above said lower beam, a support slideably mounted on said bearing surface, and a combination radial and thrust bearing mounted on said support and coupled to said upper turret portion.

11. The improvement described in claim 10 wherein:

said bearing arrangement includes a roller bearing with a lower raceway mounted on said upper beam, an upper raceway coupled to said upper turret portion, and rollers lying between said raceways and rollable along a largely circular path along said raceways as the turret turns about said axis;

said lower raceway being largely spherically curved about a center lying along said axis and above said lower raceway, and said lower raceway being wide enough to allow the path of said rollers to shift position along said lower raceway.

12. In a mooring arrangement which includes a vessel, upper and lower mounts that each include a beam with an inner portion mounted on the vessel and an outer portion and a bearing arrangement on each outer beam portion, and a turret with upper and lower portions rotatably mounted on said bearing arrangements about a largely vertical axis, wherein the turret is anchored to a sea floor by an anchor arrangement that applies a largely downward load to the turret, the improvement wherein:

said bearing arrangement allows said turret upper and lower portions to each pivot about a different horizontal axis lying substantially along said largely vertical axis, and to allow one of said turret portions to slide vertically by a limited amount relative to the corresponding beam;

said bearing arrangement includes upper and lower bearing arrangements respectively mounted on said upper and lower beams;

said upper bearing arrangement includes a combination radial and thrust bearing coupled to said turret upper portion, and a deflectable support which includes a plurality of sheets of elastomeric material and a plurality of rigid plates separating said elastomeric sheets, said deflectable support coupled to said combination bearing and to said upper beam outer portion.

13. In a mooring arrangement which includes a vessel, upper and lower mounts that each include a beam with an inner portion mounted on the vessel and an outer portion and a bearing arrangement on each outer beam portion, and a turret with upper and lower portions rotatably mounted on said bearing arrangements about a largely vertical axis, wherein the turret is anchored to a sea floor by an anchor arrangement that applies a largely downward load to the turret, the improvement wherein:

said bearing arrangement allows said turret upper and lower portions to each pivot about a different horizontal axis lying substantially along said largely vertical axis, and to allow one of said turret portions to slide vertically by a limited amount relative to the corresponding beam;

said bearing arrangement includes upper and lower bearing arrangements respectively mounted on said upper and lower beams;

said lower bearing arrangement includes a deflectable support which includes a plurality of sheets of elastomeric material and a plurality of rigid plates separating said sheets, said elastomeric sheets oriented so imaginary lines normal to locations on said sheets extend substantially horizontally.

14. The improvement described in claim 13 wherein:

said deflectable support includes a plurality of substructures spaced about said turret, each including a plurality of said elastomeric sheets separated by a plurality of said rigid plates.

* * * * *